United States Patent [19]

Derichs

[11] Patent Number: 4,781,334

[45] Date of Patent: Nov. 1, 1988

[54] METHOD AND APPARATUS FOR INCREASING THE WINDING SPEED OF AN AUTOMATIC WINDING MACHINE

[76] Inventor: Josef Derichs, Bonhoefferstrasse 12, D-4050 Mönchengladbach 1, Fed. Rep. of Germany

[21] Appl. No.: 115,976

[22] Filed: Oct. 30, 1987

[30] Foreign Application Priority Data

Oct. 31, 1986 [DE] Fed. Rep. of Germany ..... 3637172

[51] Int. Cl.[4] ..... B65H 54/22; B65H 67/02; B65H 67/06

[52] U.S. Cl. ..... 242/35.5 A; 242/18 R; 242/35.5 R; 242/54 R; 242/128

[58] Field of Search ..... 242/35.5 A, 35.5 R, 242/35.6 R, 18 R, 128, 54

[56] References Cited

U.S. PATENT DOCUMENTS 2,388,557 11/1945 Little et al. .

FOREIGN PATENT DOCUMENTS 1843547 12/1961 Fed. Rep. of Germany .
1150912 6/1963 Fed. Rep. of Germany .
1131568 1/1967 Fed. Rep. of Germany .
1254426 11/1967 Fed. Rep. of Germany .
2027134 12/1971 Fed. Rep. of Germany .
1760066 4/1972 Fed. Rep. of Germany .
2113275 9/1972 Fed. Rep. of Germany .
2139764 12/1972 Fed. Rep. of Germany .
7201128 5/1973 Fed. Rep. of Germany .
3326537 2/1984 Fed. Rep. of Germany .
3416387 11/1984 Fed. Rep. of Germany .
1209710 9/1959 France .
430537 8/1967 Switzerland .

*Primary Examiner*—Stanley N. Gilreath
*Attorney, Agent, or Firm*—Lerner and Greenberg

[57] ABSTRACT

A method and apparatus for increasing the winding speed of an automatic winding machine includes successively supplying unwinding stations of the automatic winding machine with spindles each having one spindle bearing and one cop with a cop tube having a given winding direction and being ready for unwinding. The spindles are rotated opposite the given winding direction of the cops while unwinding and removing yarn from the cop from above. The spindles are removed from the unwinding station in common with the cop tubes mounted on the spindles after unwinding.

43 Claims, 6 Drawing Sheets

METHOD AND APPARATUS FOR INCREASING THE WINDING SPEED OF AN AUTOMATIC WINDING MACHINE

The invention relates to a method and apparatus for increasing the winding speed of an automatic winding machine.

When yarn is drawn off a cop from above, the winding speed of an automatic winding machine is limited, because the yarn tension increases progressively and excessive yarn stretching and breakage increasingly occur at higher winding speeds.

It is accordingly an object of the invention to provide a method and apparatus for increasing the winding speed of an automatic winding machine, which overcomes the hereinafore-mentioned disadvantages of the heretofore-known methods and devices of this general type, which increases the winding speed of an automatic winding machine effectively in a simple manner and which increases the effectiveness of the machine.

With the foregoing and other objects in view there is provided, in accordance with the invention, a method for increasing the winding speed of an automatic winding machine, which comprises successively supplying unwinding stations of the automatic winding machine with spindles each having one spindle bearing and one cop with a cop tube having a given winding direction and being ready for unwinding, rotating the spindles opposite the given winding direction of the cops while unwinding and removing yarn from the cop from above, and removing the spindles from the unwinding station in common with the cop tubes mounted on the spindles after unwinding.

The economic advantage obtained is not only due to the fact that the winding speed can be increased substantially because of the rotating spindle, but also due to the fact that the cops do not need to be mounted on existing spindles in the feed or unwinding stations themselves, which is complicated, takes unnecessary set-up time and entails the danger of an unsuccessful change of feed spools. This last type of economic advantage is all the more important precisely because the feed spools must be changed more often at a higher winding speed.

In accordance with another mode of the invention, there is provided a method which comprises guiding the spindles in a controlled circulating path through the automatic winding machine and through a yarn supply apparatus. The yarn supply apparatus supplies the spindles with new cops. This kind of yarn supply apparatus may, for example, be a ring spinning machine, a ring twisting machine, a cop preparing station or intermediate cop storage means provided with spindle set-up means.

In accordance with a further mode of the invention, there is provided a method which comprises removing the cop tubes from the spindles arriving from the automatic winding machine, replacing the cop tubes with cops in the yarn supply apparatus and optionally searching for a yarn end on the surface of the cop and furnishing the yarn end to the top of the spindle for grasping. In this case, the cop is accordingly not formed on the spindle itself, as would be the case in ring spinning machines or ring twisting machines.

In accordance with an added mode of the invention, there is provided a method comprises rotating the spindles at the unwinding stations by means of a drive device and/or by means of yarn traction, and optionally limiting the rpm of the spindles as a function of the winding speed, such as by means of controlled braking.

In the simplest case, the spindles rotate because of the yarn traction. In this case they do not require special drive devices, such as wharves, drive motors or the like.

This kind of drive would advantageously be attained by a gentle startup of the automatic winding machine. However, a special drive device has its advantages as well, because in that case the rpm can be controlled and regulated accurately in accordance with the winding speed. However, the rpm can also be kept within limits by controlled braking.

In accordance with an additional mode of the invention, there is provided a method which comprises braking the spindles at the unwinding stations to a stop, upon yarn breakage. A spindle braking device which can be used in this case can be controlled by a yarn breakage detector.

With the objects of the invention in view there is also provided a combination of an automatic winding machine and an apparatus for increasing the winding speed of the automatic winding machine, comprising unwinding stations of the automatic winding machine, spindles having spindle bearings, and means for successively supplying the unwinding stations with the spindles each having a cop ready for unwinding, the unwinding stations including means for receiving the spindles, means for rotating the spindles for unwinding yarn from the cops, means for retaining or firmly holding the spindle bearings during unwinding and during rotation of the spindles, and means for moving the spindles onward after unwinding the cops.

In accordance with another feature of the invention, there is provided a yarn supply apparatus supplying the spindles with cops, and a controllable automatic transport system disposed between the yarn supply apparatus and the automatic winding machine.

In accordance with a further feature of the invention, the transport system is in the form of a circulating system for transporting the spindles in an upright position, the transport system having guide rails, belt conveyors or drive belts and controllable shunts.

This kind of spindle transport has decisive advantages, because no cop comes into contact with another cop.

In accordance with an added feature of the invention, each of the spindles has a bearing tube for the spindle bearing, and there are provided transport elements each being connected to a respective one of the spindles for transporting the spindles with the cops mounted thereon to and from the automatic winding machine.

The term "bearing tube" should be understood in its broadest possible sense in this context. The bearing tube is the part of the spindle that does not rotate along with the other parts. The transport element may, for example, be in the form of a pallet.

In accordance with an additional feature of the invention, the spindle has a longitudinal axis, and the transport element has a lower surface on which the spindle with the cop mounted thereon is transported in an upright position, the lower surface being substantially flat or planar and extending transversely to the longitudinal axis of the spindle.

In accordance with yet another feature of the invention, the transport element is in the form of a disk.

In accordance with yet a further feature of the invention, the transport element has a substantially central opening formed therein through which the spindle passes, and there is provided a spindle nut connecting the transport element to the bearing tube. The spindle nut presses the transport element against a collar of the bearing tube, for example.

During transportation of the structural unit according to the invention, including the spindle, the transport element and the cop tube or cop, the end of the bearing tube that protrudes downward from the transport element may be a hindrance.

Therefore, in accordance with yet an added feature of the invention, the bearing tube has a lower end flush with the lower surface of the transport element or at a higher level than the lower surface of the transport element. In this case, the structural units can be conveniently transported standing upright on flat conveyors.

In accordance with yet an additional feature of the invention, there is provided a shiftable spindle brake forming a structural unit with the transport element and the spindle. The spindle brake may be actuated, for example upon yarn breakage, in order to prevent further travel of the yarn from the cop after a yarn break by stopping the spindle as quickly as possible.

In the simplest case, the spindle can be set into rotation in the winding machine by drawing off the yarn from the spindle from above, solely by pulling on the yarn.

However, in accordance with still another feature of the invention, the spindle includes a drive element for inducing or initiating rotation of the spindle. A drive element of this kind may for example be a small electric motor or, more simply, a wharve, which can be driven by the winding machine. A drive element assures that the spindle will be driven with a defined rotational speed, for example.

In accordance with still a further feature of the invention, the drive element of the spindle is in the form of a loose wharve, and the transport element and the spindle are part of a structural unit including a shiftable coupling or clutch device for the loose wharve.

Both the spindle brake and the shiftable coupling or clutch device may be actuated from the winding machine.

In accordance with still an added feature of the invention, the structural unit includes a shiftable spindle brake. In this way, the yarn end can be presented to the winding machine in a defined position, so that the unwinding, i.e. feeding or unwinding process and hence the ensuing further transport of the spindle as well, will proceed more quickly.

In accordance with still an additional feature of the invention, there are provided drive devices disposed at the unwinding stations to be coupled to the spindles.

In accordance with again another feature of the invention, there are provided braking devices disposed at the unwinding stations to be coupled to the spindles.

In accordance with again a further feature of the invention, the means for receiving the spindles and the means for moving the spindles onward include belt conveyors, drive belts or grippers and/or shiftable shunts.

In accordance with again an added feature of the invention, the means for retaining the spindle bearings for unwinding include shiftable grippers to be pressed against the bearing tube or against the transport elements and/or shiftable locking bolts.

In the event that the structural units including the spindle and transport element have shiftable spindle brakes and/or coupling or clutch devices, in accordance with again an additional feature of the invention, the unwinding stations have shiftable actuating devices for the shiftable spindle brakes or in accordance with another feature of the invention, the unwinding stations have shiftable actuating devices for the shiftable coupling or clutch devices.

In accordance with a further feature of the invention, the unwinding stations have shifting devices or switchgear for the drive elements. For example, if the drive element includes an electric motor, then the switchgear serves, for instance, to switch the motor on and off and to supply current to the motor. If the drive element includes a wharve, for instance, then a switch gear can assure that the wharve is carried along in motion by a rotating or linearly moved element.

In accordance with an added feature of the invention there are provided drive devices disposed at the unwinding stations to be coupled to the drive elements. This can be accomplished, for example, by frictional contact, gear engagement, or the like.

In accordance with a concomitant feature of the invention, the drive devices have an endless tangential belt or a friction roller.

Other features which are considered as characteristic for the invention are set forth in the appended claims.

Although the invention is illustrated and described herein as embodied in a method and apparatus for increasing the winding speed of an automatic winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 6:
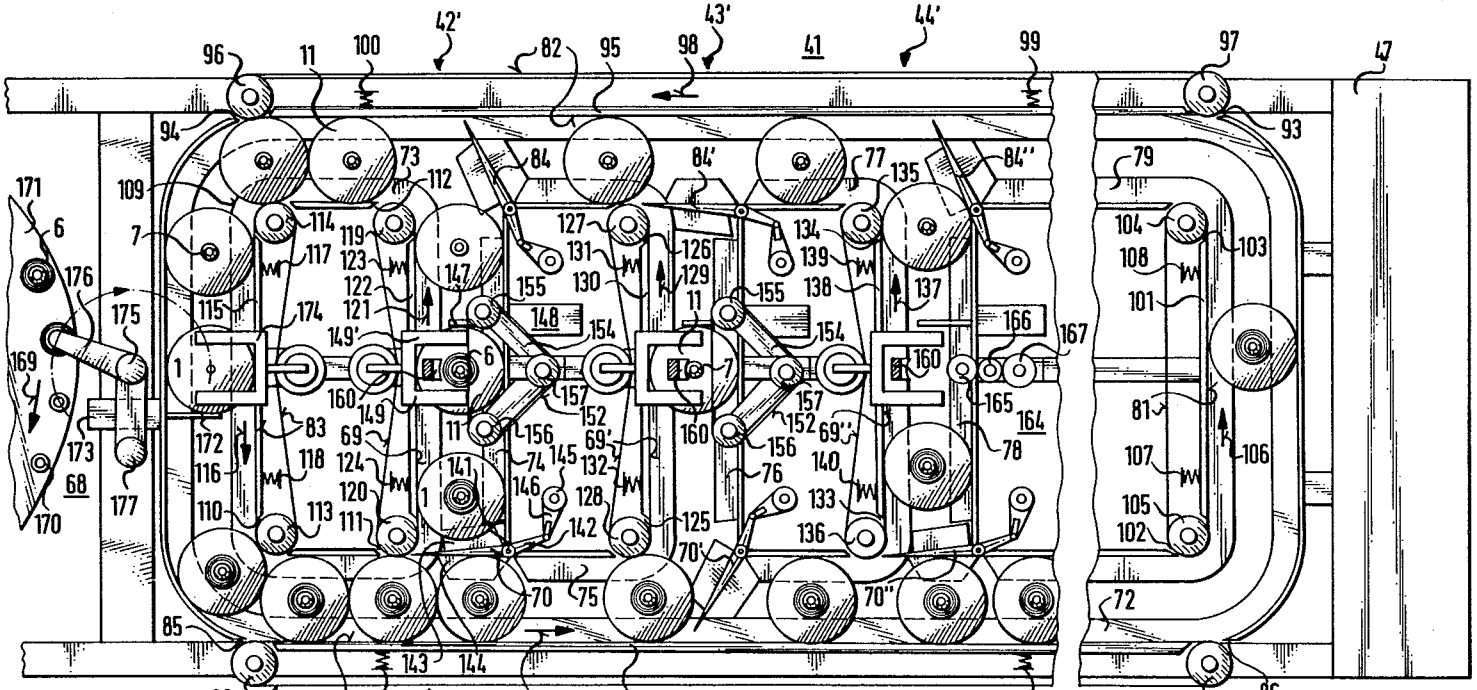
FIG. 6 is a fragmentary, top-plan view of an apparatus according to the invention.
Figure 7:
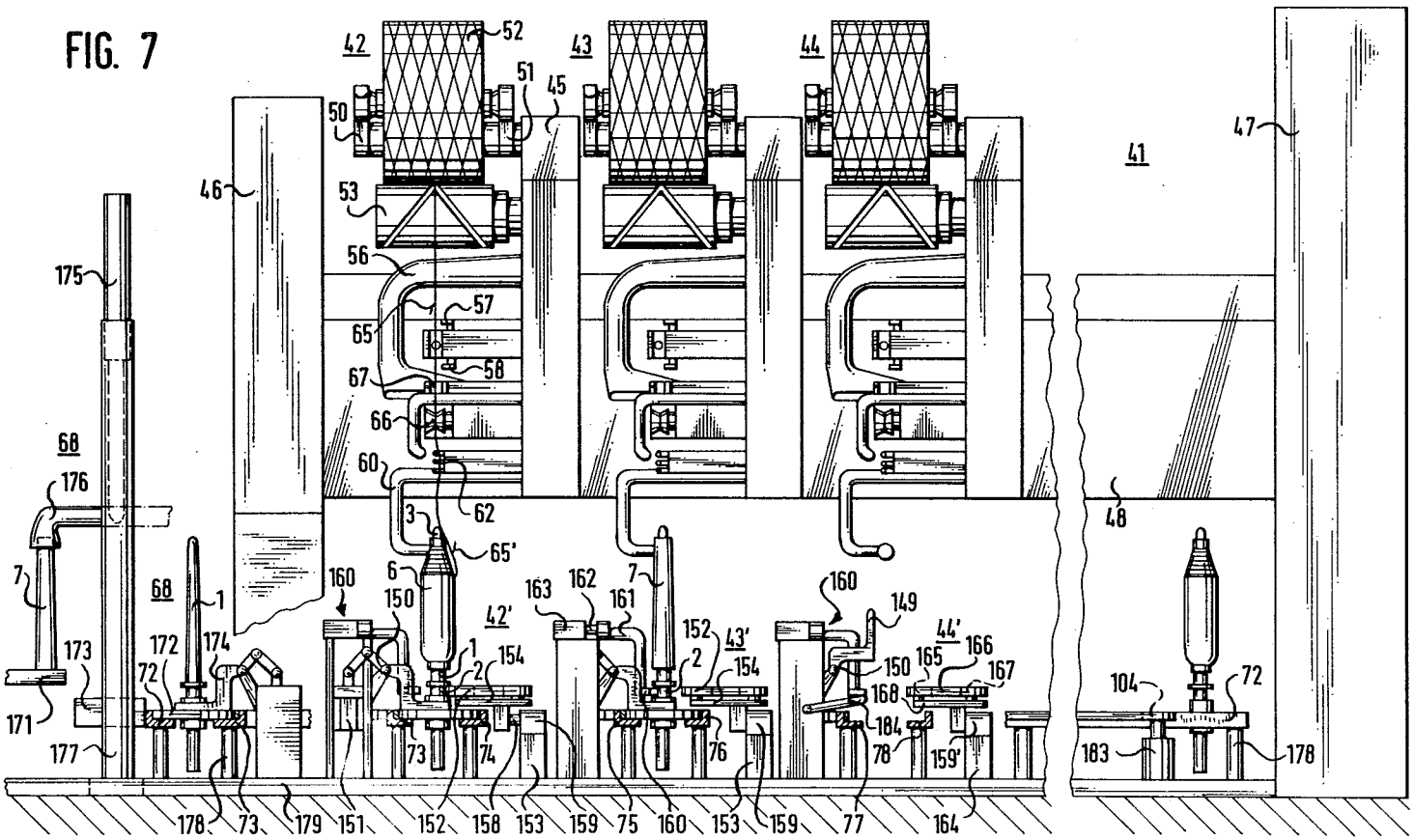
FIG. 7 is a fragmentary, front-elevational view of an automatic winding machine including important elements of the apparatus according to the invention.
Figure 8:
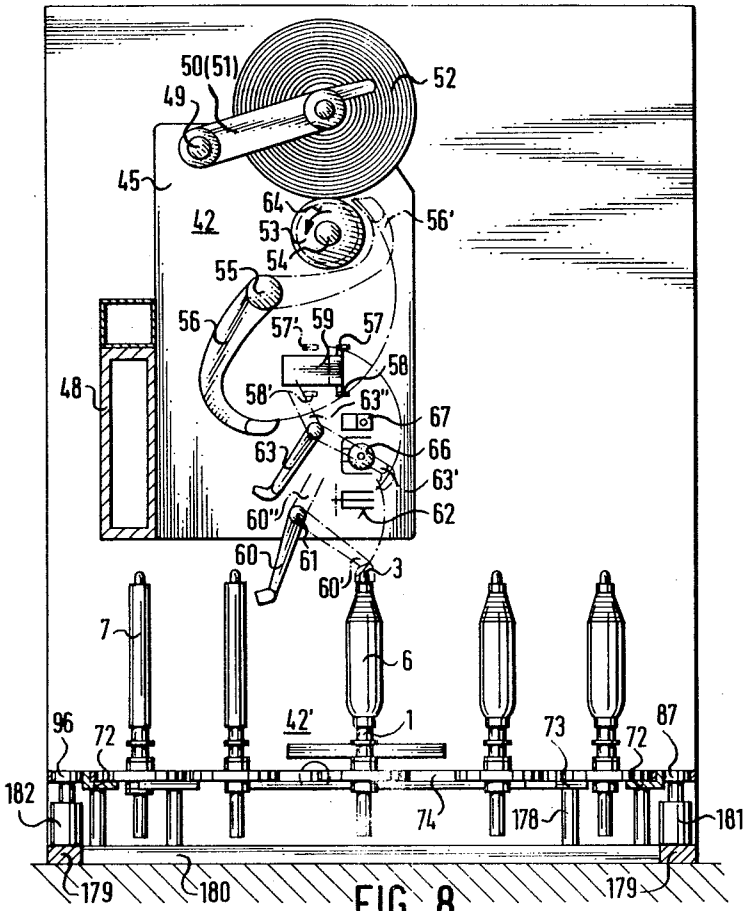
FIG. 8 is a side-elevational view of a winding station including parts of the apparatus according to the invention.

Referring now to the figures of the drawings in detail and first, particularly, to the embodiment of FIGS. 6, 7 and 8 thereof, there is seen an automatic winding machine 41, shown in particular in FIG. 7, which has a plurality of winding stations. Winding stations 42, 43, 44 and feed or unwinding stations 42', 43', 44' thereof are shown in the drawing.

All of the winding stations have the same basic structure, as will be described below taking the winding station 42 shown in FIGS. 7 and 8 as an example:

A housing 45 which includes gear elements and is secured on a carrier 48 extending from a front end frame 46 to a rear end frame 47, supports a pivot shaft 49 of a spool frame 50, 51, which in turn serves to rotatably receive a cheese or cross-wound bobbin 52 forming a take-up spool or bobbin The cheese 52 is located on a reversing thread roller 53 having a shaft 54 which is rotatably supported on the housing 45 and which is driven by transmission means that are located in the interior of the housing 45.

A first suction tube 56 is also supported on the housing 45 in such a way as to be pivotable about a pivot point 55. As shown in FIG. 8, the suction tube 56 can be pivoted upward into a position 56' in order to search for a yarn end on the surface of the cheese 52, pick it up by suction and present it to feeder arms 57, 58 of an automatic yarn splicing device 59, upon pivoting back into the initial position. A second suction tube 60 is supported on the housing 45 so as to be pivotable about a pivot point 61. The suction tube 60 serves to retrieve a yarn end 5 shown in FIG. 1 from the top 3 of a spindle 1, which carries a cop 6 having the yarn end 5. To this end, the suction tube 60 is movable first into a position 60' and finally into a position 60''. In the position 60', the yarn end is drawn away from the spindle top 3 and aspirated. In the position 60'', the yarn end 5 is inserted into a rake or comb feeler 62, whereupon the suction tube 60 then pivots onward in a circle, until it has returned to its initial position once again. In so doing, the suction tube 60 releases the yarn end.

A third suction tube 63 is pivotable from a rest position through a suction position 63' into a transfer position 63''. In the suction position 63', the suction tube 63 receives the yarn end retained by the rake feeler 62 and then in the transfer position 63'', it presents the yarn end to the feeder arms 57, 58 of the yarn splicing device 59.

As the two feeder arms 57, 58 are moved into respective positions 57' and 58', both yarn ends enter the yarn splicing device 59, which can therefore effect yarn joining by splicing in the conventional manner. If the reversing thread roller 53 is then set into motion in the direction of a curved arrow 64, yarn 65 shown in FIG. 7 is continuously drawn off overhead from the cop 6, forming a yarn balloon 65'. The yarn is delivered through the rake feeler 62, a yarn brake 66 and a measuring slit of a yarn cleaner 67 to the reversing thread roller 53 and hence to the cheese 52.

The yarn is drawn off and the cops 6 serving as feed spools are changed in accordance with the method of the invention. To this end, the spindles 1 are guided in a controlled circulating pattern by means of the automatic winding machine 41 and by means of a yarn supply apparatus generally identified by reference numeral 68. The yarn supply apparatus 68 is located immediately next to the front end frame 46 of the automatic winding machine 41.

Figure 1:
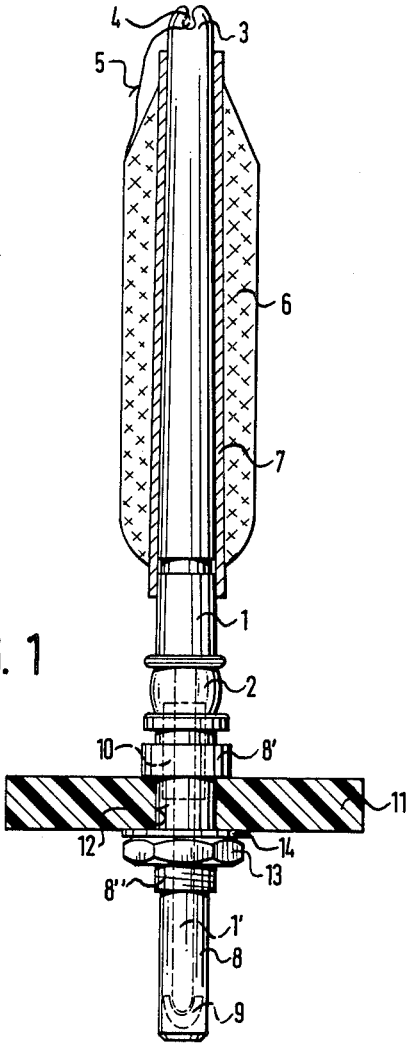
FIG. 1 is a diagrammatic, cross-sectional view of a spindle with a cop and a transport element.
Figure 2:
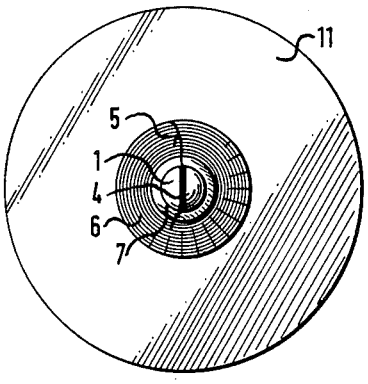
FIG. 2 is a top-plan view of the assembly of FIG. 1.

FIGS. 1 and 2 show that the spindles 1 are provided with spindle bearings 9, 10 and bearing tubes 8 are each connected to a transport element 11, serving to transport the spindle with the cop 6 mounted thereon to and from the automatic winding machine 41.

The spindle 1 according to FIGS. 1 and 2 is provided with a drive element 2 in the form of a wharve that induces the rotation. The top 3 of the spindle has a yarn receiving element 4 in the form of a channel which is open at the top for receiving a yarn end 5 of the cop 6. A conical cop tube or pirn 7 is slipped onto the spindle 1 from above in a friction-locking manner. A tapered lower end 1' of the spindle 1 is supported inside the bearing tube 8 in the spindle bearings 9 and 10. The spindle bearing 9 is in the form of a step, thrust or conical bearing, while the spindle bearing 10 is in the form of a neck journal or journal bearing.

The bearing tube 8 includes a collar 8' and a threaded section 8''. The disk-like transport element 11 is provided with a central bore 12, which permits threading onto the threaded section 8''. A spindle nut 13 tightly screws the transport element 11 against the collar 8' with a shim 14 therebetween, so as to be secured against unintentional loosening. The transport element 11 is manufactured from a metal-lined plastic plate.

Figure 3:
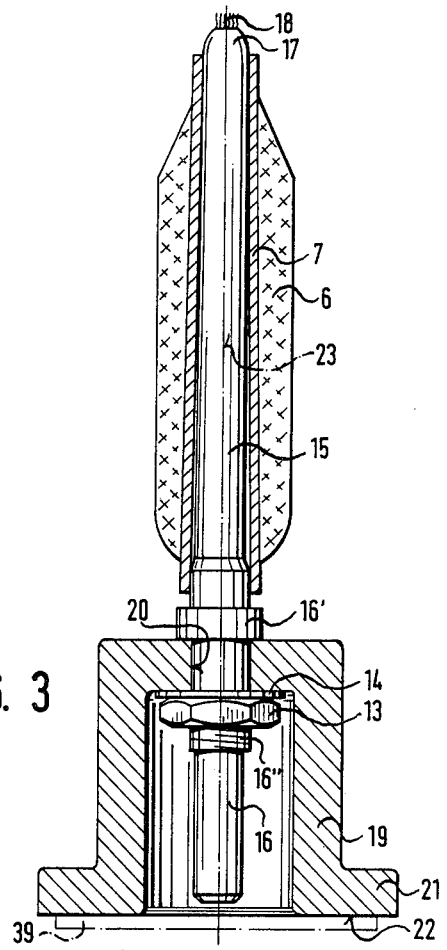
FIG. 3 is a view similar to FIG. 1 of another embodiment of a spindle with a transport element and a cop.
Figure 4:
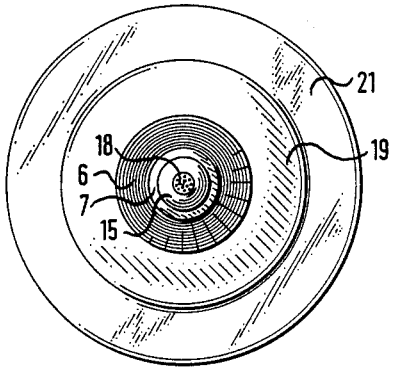
FIG. 4 is a top-plan view of the assembly of FIG. 3.

In the embodiment of FIGS. 3 and 4, a spindle 15 is provided which does not have a special drive element in the form of a wharve. Therefore, a bearing tube 16 is provided with a collar 16' and a threaded section 16'', which is somewhat shorter than the bearing tube 8 of the previous embodiment.

In the embodiment according to FIGS. 3 and 4, the spindle has a top 17 with a yarn receiving element 18 in the form of a brush.

A transport element 19 which is cup-shaped is provided. A central bore 20 of the transport element 19 is threaded onto the threaded section 16''. The transport element 19 has an enlarged rim 21, the entire lower surface 22 of which is flat and extends transversely to the longitudinal axis 23 of the spindle 15. The lower surface 22 of the transport element 19 is located at a lower level than the lower end of the bearing tube 16. The transport element 19, which is made of light metal in the illustrated embodiment, is pressed against the collar 16' by the spindle nut 13 with the shim 14 therebetween, so as to be secured against unintentional loosening.

The embodiment of FIG. 5 differs from the embodiment of FIGS. 1 and 2 in the following respects:

A tapered lower end 24' of a spindle 24 has a collar 25 and a tube 26. A roller bearing 27 is supported against the collar 25 and the tube 26. The roller bearing 27 has the wharve, in the form of a loose wharve 28. The wharve 28 has a conical surface 29 in the interior thereof, against which a clamping ring 31 having two cones axially one behind the other is pressed, under the influence of a compression spring 30. The clamping ring 31 is pressed between the tube 26 and the conical surface 29, causing the loose wharve 28 to come into frictional contact with the tube 26 and thus with the spindle 24. A conical shell or jacket 32 of a tube 33 fits over the lower cone of the clamping ring 31. The lower end of the conical shell 32 has a collar 34 under the loose wharve 28. A portion of the collar 34 engages a coupling or clutch lever 35, which is pivotably supported on a bearing block 36 joined with the transport element 11. Elements 29–36 form a shiftable coupling or clutch device for the loose wharve 28. At the same time, however, they also form a shiftable spindle brake. The brake is formed due to the fact that when a pressure plate 37 of the coupling or clutch lever 35 is depressed, the coupling lever 35 carries the collar 34 along with it, whereupon the conical shell 32 presses against the lower cone of the clamping ring 31, thus pulling the clamping ring downward against the force of the compression spring 30 and effecting braking, while the operative connection with the loose wharve 28 is interrupted. During the braking, the clamping ring 31 is clamped in place between the tube 26 and the conical shell 32, so that the spindle 24 is at a standstill after a brief braking period.

Figure 5:
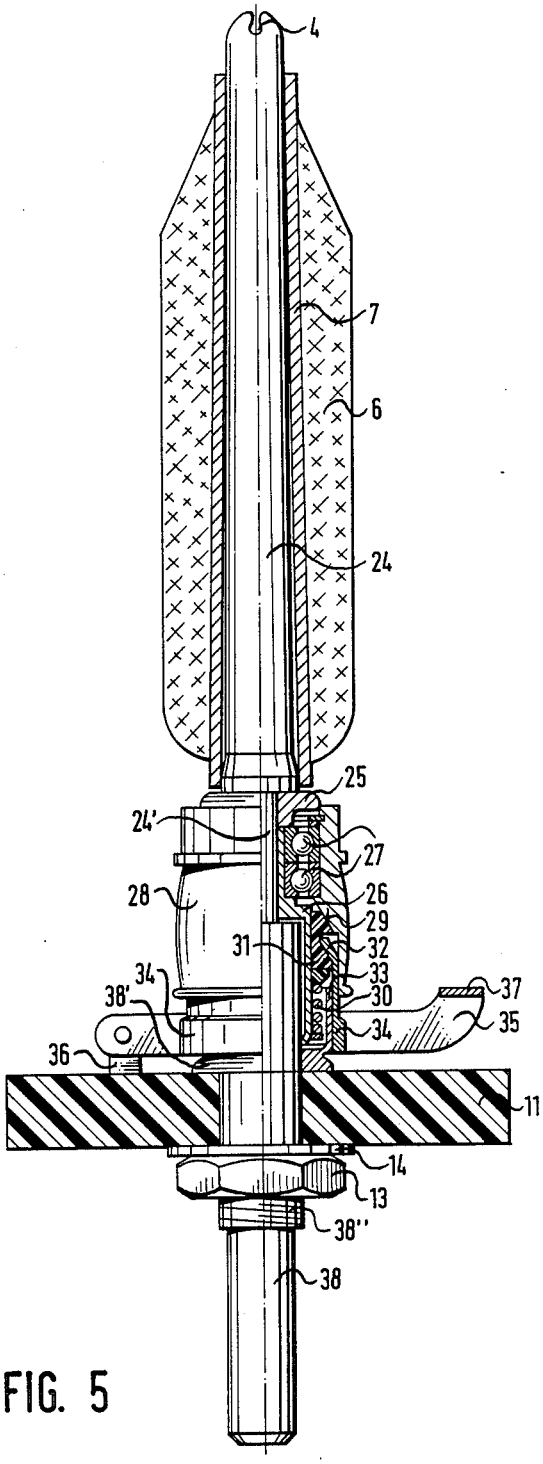
FIG. 5 is a partly cross-sectional view of a further embodiment of a spindle with a cop and a transport element.

A bearing tube 38 in the embodiment of FIG. 5 has a collar 38' and a threaded section 38''. As in the first embodiment, the transport element 11 is screwed tightly against the collar 38' by means of the spindle nut 13, with the shim 14 therebetween, so as to be secured against unintentional loosening.

The feed or unwinding stations 42', 43' and 44'' of the automatic winding machine 41 are equipped with means for receiving the spindles 1 equipped with cops 6, for firmly retaining the spindle bearings 9, 10 during feeding or unwinding and during rotation of the spindles 1 and for moving the spindles 1 onward after feeding or unwinding. As shown particularly in FIG. 6, the means for receiving and moving the spindles 1 onward each have one endless drive belt 69, 69', 69'' and one shiftable shunt 70.

The automatic controllable transport system will first be described in detail before describing further details of the feed or unwinding stations. This system is generally identified at reference numeral 71 in FIG. 6.

The transport system 71 is a circulating system for transporting the spindles 1 in an upright position, which includes guide rails 72–79, drive belts 80–83, the aforementioned drive belts 69 including the drive belts 69', 69'' of the same type for the other feed or unwinding stations 43', 44', the aforementioned shunt 70 and shunts 70', 70'', 84, 84' and 84''.

The guide rails 72–79 have an L-shaped profile and some of them are in the form of circular-path rails while others are in the form of straight rails, as shown in FIG. 6. The profile has recesses at various points, which will be described in further detail below.

The guide rail 72 is guided in a closed loop near the bottom, around the winding stations of the automatic winding machine 41 and through the yarn supply apparatus 68. The guide rail 73 is located opposite the guide rail 72, from which it is spaced apart by approximately the diameter of one transport element 11.

The guide rail 73 extends in a closed loop through the feed or unwinding station 42' and through the yarn supply apparatus 68. The guide rail 74 is opposite the guide rail 73, spaced apart from it by approximately the diameter of one transport element 11 and extended through the feed or unwinding station 42'. As viewed from above, the guide rail 75 is in the form of an inverted C. The guide rail 75 extends through the feed or unwinding station 43', is disposed with a front portion thereof facing a front longitudinal section of the guide rail 72 and a rear portion thereof facing a rear longitudinal section of the guide rail 72 and is spaced apart from the guide rail 72 by approximately the diameter of one transport element 11.

The guide rail 77 has the same shape as the guide rail 75, except that it is guided through the feed or unwinding station 44'. The guide rail 76 is guided through the feed or unwinding station 43' parallel to the guide rail 75 but spaced apart from it by approximately the diameter of one transport element 11. The guide rail 78 is guided through the feed or unwinding station 44', parallel to the guide rail 77 but spaced apart from it by approximately the diameter of one transport element 11. The guide rail 79 leads behind the last winding station from the front to the back of the automatic winding machine 41. Over the entire course thereof, the guide rail 79 is parallel to the guide rail 72 but is spaced apart therefrom by approximately the diameter of one transport element 11.

The upright portion of the guide rail 72 has recesses 85 and 86 at the beginning and end of the straight portion thereof located at the front of the automatic winding machine 41. A drive roller 87 is disposed in the recess 86, and a deflector roller 88 of the drive belt 80 is disposed in the recess 85. The straight portion of the drive belt 80 extending in the direction of an arrow 89 runs in front of an upright wall section 90 and along the inside thereof. The wall section 90 is loaded by springs 91 and 92, so that the drive belt 80 always makes good contact with the wheels of the drive elements 11, as FIG. 6 shows. During the transporting operation, the transport elements 11 driven by the drive belt roll along the upright portion of the wall of the guide rail facing the drive belt.

Further recesses 93 and 94 are located in the upright wall section 95 of the guide rail 72 on the back of the automatic winding machine 41. A drive roller 96 is disposed in the recess 94, and a deflector roller 97 of the drive belt 82 is disposed in the recess 93. The straight section of the drive belt 82 extending in the direction of an arrow 98 runs along the inside of the wall portion 95, which is loaded by springs 99, 100, similarly to the wall section 90.

An upright wall section 101 of the guide rail 79 has recesses 102 and 103 formed therein at points at which the guide rail 79 changes its direction. A drive roller 104 is disposed in the recess 103, and a deflector roller 105 of the drive belt 81 is disposed in the recess 102. A straight section of the drive belt 81 extending in the direction of an arrow 106 travels past the inside of the wall section 101. The wall section 101 is loaded by springs 107, 108, which have the same function as the aforementioned springs 91 and 92.

The guide rail 73 which extends in a loop has respective recesses 109, 110, 111 and 112 located at each of four points at which it changes its direction. A drive roller 113 is located in the recess 110 and a deflector roller 114 of the drive belt 83 is located in the recess 109. The straight section of the drive belt 83 extending in the direction of an arrow 116 is guided along the inside of an upright wall section 115. The wall section 115 is loaded by springs 117 and 118.

A drive roller 119 is located in a recess 112 and a deflector roller 120 of the drive belt 69 is located in the recess 111. The straight section of the drive belt 69 extending in the direction of the arrow 121 is guided along the inside of an upright wall section 122 of the guide rail 73. The wall section 122 is loaded with springs 123 and 124.

The upright portion of the guide rail 75 has recesses 125 and 126 formed therein at points at which it changes its direction. A drive roller 127 is located in the recess 126, and a deflector roller 128 of the drive belt 69' is located in the recess 125. The straight section of the drive belt 69' extending in the direction of an arrow 129 is guided along the inside of a wall section 130. The wall section 130 is loaded with springs 131 and 132.

The upright portion of the guide rail 77 has recesses 133 and 134 formed therein at points at which it changes its direction. A drive roller 135 is located in the recess 134, and a deflector roller 136 of the drive belt 69'' is located in the recess 133. The straight section of the drive belt 69'' extending in the direction of an arrow 137 is guided along the inside of an upright wall section 138 which is loaded with springs 139 and 140.

The shunts 70, 70' and 70'' mentioned above are located at the front ends of the guide rails 74, 76 and 78. The aforementioned shunts 84, 84' and 84'' are located at the rear ends of the same guide rails.

In principle, all the shunts have the same structure. Accordingly, this structure will be described in detail referring to the shunt 70.

The shunt 70 is in the form of an upright tray, which can be pivoted about a vertical pivot shaft 141 from the closing position shown into an opening position, with the aid of a lever 142. The shunt 70' is shown by way of example in the opening position.

The shunt 70 has horizontal fins 143 and 144 approximately at the level of the horizontal wall sections of the guide rails. The fins 143 and 144 serve as a bearing surface for the transport elements 11. The lever 142 is pivotably connected to an indexing shaft 145. The indexing shaft 145 has an indexing lever 146, which can assume two positions. The indexing lever 146 assumes the closing position for the shunt 70, while it assumes the opening position for the shunt 70', for example. A non-illustrated shifting mechanism shifts the indexing shaft 145 into one of the two positions, depending on the cop supply of the winding station.

If all of the shunts were closed and all of the drive belts were in operation, the spindles would travel in an upright position in a circular path through the yarn supply apparatus 68, along the front of the automatic winding machine 41, behind the last winding station and behind the automatic winding station 41, back to the yarn supply apparatus 68.

Besides the shunts 70, 70' and 70'', the feed or unwinding stations 42', 43' and 44' have still other means for receiving the spindles 1 equipped with cops 6. These means are in the form of the drive belts 69, 69', 69'' already mentioned. In addition, means for firmly retaining the spindle bearings or the transport elements 11 connected to the bearing tubes 8 for the feeding or unwinding operation are also provided at the feed or unwinding stations 42', 43', 44'. These means each include one shiftable locking bolt 147, which can be advanced or retracted by means of an electromagnet drive 148. In the advanced state, the locking bolt 147 prevents the further travel of a transport element 11, as is the case, for example, at the feed or unwinding station 42' and the feed or unwinding station 43'. The drive belts 69 and 69' that continue to travel do attempt to carry the transport elements along with them. However, since they do not succeed in doing so, they can at best cause the transport elements 11 to rotate on the spot. However, this is undesirable, and further retention means are provided to prevent it. These retention means are in the form of grippers 149, 149' that can be pressed from above against the transport element 11. FIG. 7 shows that the grippers can be pivoted through approximately 90° about a pivot shaft 150, out of a rest position into the retention position. The pivoting is provided by a controllable pneumatic piston/cylinder unit 151. In FIG. 7, the rest position is shown for the feed or unwinding station 44', while the retention position is shown for the feed or unwinding stations 42' and 43'.

FIGS. 6 and 7, in particular, show that drive devices that can be coupled to the spindles 1 are disposed on the feed or unwinding stations 42', 43', 44' of the automatic winding machine 41. More specifically, these drive devices can be coupled to the drive elements, that is to the wharves 2 of the spindles 1. This kind of drive device 153 seen in FIG. 7 has one endless tangential belt 152 at each of the feed or unwinding stations 42' and 43', which is guided about guide rollers 155, 156 which are rotatably supported on a plate 154 and about a drive roller 157. As FIG. 7 shows, the plate 154 is secured on a push rod 158 of a pneumatically controllable piston/cylinder unit 159.

In FIG. 7, it is shown at the feed or unwinding station 42' that the push rod 158 is extended, causing the tangential belt 152 to make contact with the wharve 2, so that when the tangential belt 152 is in motion, the spindle 1 rotates along with the cop 6. FIG. 7 shows that the push rod for the feed or unwinding station 43' is retracted, causing the tangential belt 152 to be lifted away from the wharve 2.

FIG. 6 shows that at the feed or unwinding station 42' the cop 6 is still rotating, while a further spindle 1 is already ready for feeding or unwinding. The diameter of the transport elements 11 are large enough to ensure that adjacent cops do not touch one another, and one cop does not prevent feeding or unwinding from another cop even if the transport elements 11 are in contact with one another. Accordingly, there is no problem whatsoever in keeping a further structural unit including a cop and a spindle in readiness next to the cop that is just then being unwound. Immediately after the cop 6 has run out, the locking bolt 147 is retracted and at the same time the grippers 149, 149' are pivoted upward, so that the moving drive belt 69 transports the transport element 11 further, and the next transport element in succession takes its place and is prevented from moving further by the locking bolt 147 which is then moving outward again. At that point, the grippers 149, 149' can pivot downward again in order to retain the next transport element 11 in succession. In order to transfer the empty spindles to the circulating system, the shunt 84 is opened and then subsequently closed again, so as not to hinder the remaining circulation. Regardless of this, the shunt 70 can then be opened as well, in order to take the next feed unit out of circulation so as to put it to use. After this removal, the shunt 70 is then closed as well, so as not to hinder the remaining circulation.

FIGS. 6 and 7 also show that the feed or unwinding stations 42', 43' and 44' each have brake devices 160 that can be coupled to the spindle 1. These are shoe brakes that can be placed against the wharve 2. The shoe brake 160 is located at the end of a curved lever 161, which is connected to a push rod 162 of a controllable pneumatic piston/cylinder unit 163. FIG. 7 shows that the brake device 160 at the feed or unwinding station 42' is retracted. The same is true for the feed or unwinding station 44'. On the other hand, in the case of the feed or unwinding station 43', the brake device 160 is pressed against the wharve 2, while the tangential belt 152 is lifted away from the wharve 2. Accordingly, at the feed or unwinding station 43', the cop tube 7 that has already become empty has been brought to a standstill.

FIG. 6 shows that a drive device 164 for the spindle which uses a friction roller 165, is disposed at the feed or unwinding station 44' instead of a tangential belt 152. The friction roller 165 is in contact with two further friction rollers 166 and 167. The friction roller 167 is driven by an electric motor. The friction rollers are mounted on a plate 168, which is secured on a push rod of a shiftable pneumatic piston/cylinder unit 159'.

In the yarn supply apparatus 68, empty cop tubes 7 are removed from the spindles 1 and slipped onto mounting mandrels 170 of a disk 171 that is indexed farther in the direction of the arrow 169. The disk 171 also brings new cops 6, which are removed from the disk and slipped onto the spindles 1 in place of the cop tubes 7 that have run out. A non-illustrated sensor detects whether an arriving spindle still has a cop. Such a spindle travels unhindered through the yarn supply apparatus. All of the other spindles are resupplied with new cop tubes.

In order to perform these tasks, the yarn supply apparatus 68 is provided with special devices. First, a locking bolt is advanced by means of an electromagnet drive 173, in order to stop the transport element 11 of an arriving spindle 1. Subsequently, a gripper device 174 comes into action, in order to temporarily retain the transport element 11. The gripper device 174 has basically the same structure as the gripper devices 149, 149' already described. A pneumatic gripper device 176 secured to a lifting cylinder 175, which is movable up and down, is pivotable and likewise operates cyclically, performs the removal of the cop tubes and the slipping on of new cops. Once the cop has been slipped on, the locking bolt 172 is retracted, and immediately after that, after the transport element 11 has travelled past, it is advanced once again in order to stop the next transport element. The cycle is triggered by the arrival of a new transport element at the yarn supply apparatus 68. A stand 177 supports the lifting cylinder 175 and the gripper device 176.

FIG. 6 shows that a total of 21 spindles capable of being transported in an upright position are in motion, revolving in the controlled circulatory system. Broken lines indicate that the automatic winding machine may also have more than three winding stations, so that substantially more spindles may also be in revolving motion under some circumstances.

One embodiment of the spindles used in this revolving system is shown in FIGS. 1 and 2. Other embodiments are shown in FIGS. 3–5.

FIG. 3 shows that with a different construction of the transport system, the spindle transport can also be effected on conveyor belts 39, especially in cases in which the bearing tube does not protrude downward.

FIGS. 7 and 8 indicate that the various guide rails are joined to floor supports 179, 180 by means of vertical props 178. The floor supports may form a frame resting on the floor, which may also support the end sections 46, 47 of the automatic winding machine 41. FIGS. 7 and 8 also show the drive motors 181, 182, 183 of some drive rollers of the drive belts.

If transportable spindles of the type shown in FIGS. 3 and 4 are to be used, then the drive devices remain out of operation and the brake devices are applied directly against the spindles 15 during braking.

In FIG. 7 it is indicated that the feed or unwinding station 44' is configured for the use of the transportable spindles 24 shown in FIG. 5. To this end, the feed or unwinding station 44' is equipped with an actuating device 184 for the shiftable spindle brake 32 and the shiftable coupling or clutch device 29–36 of the spindle 24. The actuating device 184 is a pivotable lever, which upon pivoting downward presses upon the pressure plate 37 of the coupling lever 35 seen in FIG. 5 and thereby uncouples the wharve 28 while simultaneously braking the spindle 24. In this case, the brake device 160 of the machine itself is not activated.

Figure 9:
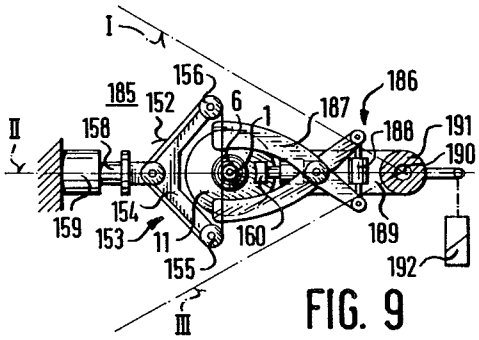
FIG. 9 is a top-plan view showing parts of the apparatus according to the invention at a feed or unwinding station.

The plan view of FIG. 9 shows a portion of an alternative feed or unwinding station 185. The feed or unwinding station 185 is equipped with the drive device 153 already described. The means for receiving and moving on the spindles 1 provided with transport elements 11 and equipped with cops 6 are combined in this case into one apparatus 186, which also has the braking device 160.

Otherwise, the apparatus 186 includes gripper tongs 187, which can be opened and closed by means of a pneumatic controllable piston/cylinder unit 188 and which are pivotably supported on an outrigger 189 of a tube 191 that is pivotable about an upright rod 190. With the aid of an indexing magnet 192, the tube 191 can be rotated and the outrigger 189 can thereby be moved into three positions, which are represented by central axes and indicated by reference numerals I, II and III. In position I the gripper tongs 187 are opened, in order to receive the transport element 11 of a spindle 1 delivered to that point and to retain it after the closure of the gripper tongs. In position II, the drive of the spindle 1 and the feeding or unwinding from the cop 6 then takes place. Subsequently, the outrigger 189 is moved into the position III, in which the gripper tongs 187 opens again in order to release the transport element 11 so that it can be transported onward. The reception of a new transport element then takes place again in position I. The braking device 160 functions in the same way as already described above.

In this alternative embodiment, under some circumstances it may be possible to omit of the rail configurations extending crosswise through the winding station at the feed or unwinding stations, and optionally to omit the shunts as well.

Figure 10:
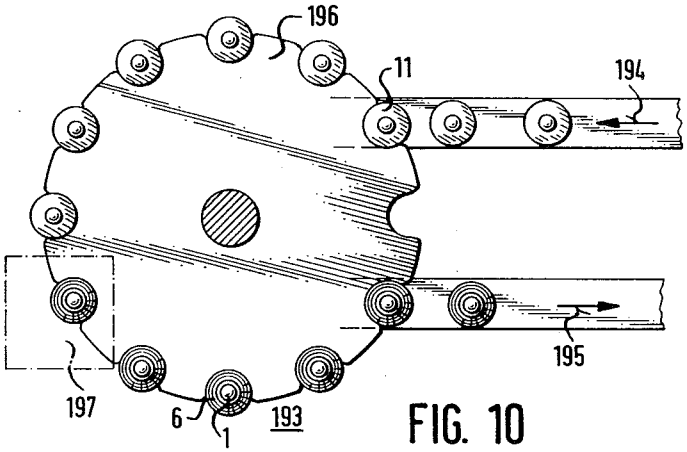
FIG. 10 is a fragmentary, highly diagrammatic view of a circulating spindle system.

FIG. 10 diagrammatically shows an alternative embodiment of a yarn supply apparatus 193. Transport elements 11 arriving in the direction of an arrow 194 are introduced directly into pockets of a disk 196. The disk 196 travels through a filling station 197, at which the spindles 1 are resupplied with cops 6, which reach the automatic winding machine in the direction of an arrow 195 from the pockets of the disk 196.

I claim:

1. Method for increasing the winding speed of an automatic winding machine, which comprises successively supplying unwinding stations of the automatic winding machine with spindles each having one spindle bearing and one cop with a cop tube having a given winding direction and being ready for unwinding, rotating the spindles opposite the given winding direction of the cops while unwinding and removing yarn from the cop from above, and removing the spindles from the unwinding station in common with the cop tubes mounted on the spindles after unwinding.

2. Method according to claim 1, which comprises guiding the spindles in a controlled circulating path through the automatic winding machine and through a yarn supply apparatus.

3. Method according to claim 2, which comprises removing the cop tubes from the spindles arriving from the automatic winding machine and replacing the cop tubes with cops in the yarn supply apparatus.

4. Method according to claim 3, which comprises searching for a yarn end on the surface of the cop and furnishing the yarn end to the top of the spindle for grasping.

5. Method according to claim 1, which comprises rotating the spindles at the unwinding stations by means of a drive device.

6. Method according to claim 5, which comprises limiting the rpm of the spindles as a function of the winding speed.

7. Method according to claim 1, which comprises rotating the spindles at the unwinding stations by means of yarn traction.

8. Method according to claim 7, which comprises limiting the rpm of the spindles as a function of the winding speed.

9. Method according to claim 1, which comprises limiting the rpm of the spindles as a function of the winding speed by means of controlled braking.

10. Method according to claim 1, which comprises braking the spindles at the unwinding stations to a stop, upon yarn breakage.

11. In combination, an automatic winding machine and an apparatus for increasing the winding speed of the automatic winding machine, comprising unwinding stations of the automatic winding machine, spindles having spindle bearings, and means for successively supplying said unwinding stations with said spindles each having a cop ready for unwinding, said unwinding stations including means for receiving said spindles, means for rotating said spindles for unwinding yarn from the cops, means for retaining said spindle bearings during unwinding and during rotation of said spindles, and means for moving said spindles onward after unwinding the cops.

12. Combination according to claim 11, comprising a yarn supply apparatus supplying said spindles with cops, and a controllable automatic transport system disposed between said yarn supply apparatus and the automatic winding machine.

13. Combination according to claim 12, wherein said transport system is in the form of a circulating system for transporting said spindles in an upright position, said transport system having guide rails, drive means and controllable shunts.

14. Combination according to claim 13, wherein said drive means are in the form of belt conveyors.

15. Combination according to claim 13, wherein said drive means are in the form of drive belts.

16. Combination according to claim 11, wherein each of said spindles has a bearing tube for said spindle bearing, and including transport elements each being connected to a respective one of said spindles for transporting said spindles with the cops mounted thereon to and from the automatic winding machine.

17. Combination according to claim 1, wherein said spindle has a longitudinal axis, and said transport element has a lower surface on which said spindle with the cop mounted thereon is transported in an upright position, said lower surface being substantially flat and extending transversely to said longitudinal axis of said spindle.

18. Combination according to claim 16, wherein said transport element is in the form of a disk.

19. Combination according to claim 16, wherein said transport element has a substantially central opening formed therein through which said spindle passes, and including a spindle nut connecting said transport element to said bearing tube.

20. Combination according to claim 16, wherein said bearing tube has a lower end flush with said lower surface of said transport element.

21. Combination according to claim 16, wherein said bearing tube has a lower end at a higher level than said lower surface of said transport element.

22. Combination according to claim 16, including a shiftable spindle brake forming a structural unit with said transport element and said spindle.

23. Combination according to claim 16, wherein said spindle includes a drive element for inducing rotation of said spindle.

24. Combination according to claim 23, wherein said drive element of said spindle is in the form of a loose wharve, and said transport element and said spindle are part of a structural unit including a shiftable coupling or clutch device for said loose wharve.

25. Combination according to claim 24, wherein said structural unit includes a shiftable spindle brake.

26. Combination according to claim 1, wherein said spindle has a top with a yarn receiving element for an end of yarn wound on the cop.

27. Combination according to claim 11, including drive devices disposed at said unwinding stations to be coupled to said spindles.

28. Combination according to claim 11, including braking devices disposed at said unwinding stations to be coupled to said spindles.

29. Combination according to claim 11, wherein said means for receiving said spindles and said means for moving said spindles onward include belt conveyors.

30. Combination according to claim 11, wherein said means for receiving said spindles and said means for moving said spindles onward include drive belts.

31. Combination according to claim 11, wherein said means for receiving said spindles and said means for moving said spindles onward include grippers.

32. Combination according to claim 11, wherein said means for receiving said spindles and said means for moving said spindles onward include shiftable shunts.

33. Combination according to claim 11, wherein said means for retaining said spindle bearings for unwinding include shiftable grippers to be pressed against said bearing tube.

34. Combination according to claim 33, wherein said means for retaining said spindle bearings for unwinding also include shiftable locking bolts.

35. Combination according to claim 16, wherein said means for retaining said spindle bearings for unwinding include shiftable grippers to be pressed against said transport elements.

36. Combination according to claim 35, wherein said means for retaining said spindle bearings for unwinding also include shiftable locking bolts.

37. Combination according to claim 22, wherein said unwinding stations have actuating devices for said shiftable spindle brakes.

38. Combination according to claim 24, wherein said unwinding stations have shiftable actuating devices for said shiftable coupling or clutch devices.

39. Combination according to claim 23, wherein said unwinding stations have shifting devices for said drive elements.

40. Combination according to claim 23, including drive devices disposed at said unwinding stations to be coupled to said drive elements.

41. Combination according to claim 27, wherein said drive devices have an endless tangential belt.

42. Combination according to claim 27, wherein said drive devices have a friction roller.

43. Apparatus for increasing the winding speed of an automatic winding machine, comprising unwinding stations, spindles having spindle bearings, and means for successively supplying said unwinding stations with said spindles each having a cop ready for unwinding, said unwinding stations including means for receiving said spindles, means for rotating said spindles for unwinding yarn from the cops, means for retaining said spindle bearings during unwinding and during rotation of said spindles, and means for moving said spindles onward after unwinding the cops.

* * * * *